United States Patent [19]

Sud

[11] 4,165,824

[45] Aug. 28, 1979

[54] SELF CLEANING SHAMPOO DISPENSER

[76] Inventor: Mohinder P. Sud, 260 Patterson St., Newmarket, Ontario, Canada, L3Y 3L8

[21] Appl. No.: 790,851

[22] Filed: Apr. 25, 1977

[30] Foreign Application Priority Data

May 10, 1976 [CA] Canada ..... 252072

[51] Int. Cl.[2] ..... G01F 11/04

[52] U.S. Cl. ..... 222/341; 222/385; 417/498

[58] Field of Search ..... 222/181, 185, 309, 383, 222/385, 340, 341; 417/498

[56] References Cited

U.S. PATENT DOCUMENTS

| | | | |
|---|---|---|---|
| 828,445 | 8/1906 | Wares et al. | 222/383 X |
| 920,931 | 5/1909 | Donnelly | 222/341 |
| 968,498 | 8/1910 | Squadrilli | 222/181 |
| 1,174,674 | 3/1916 | Byer | 222/383 X |
| 2,594,223 | 4/1952 | Santarelli | 222/385 |
| 3,203,597 | 8/1965 | Birch | 222/383 X |
| 3,940,070 | 2/1976 | Boris | 222/385 X |

*Primary Examiner*—Robert J. Spar
*Assistant Examiner*—Francis J. Bartuska

[57] ABSTRACT

This invention is a manually operated liquid dispenser designed in particular to dispense heavy soaps like hair washing shampoo. The dispensers which are presently available on the market are unsuitable for these reasons, (a) too expensive to manufacture, (b) have too many parts, (c) plug up the dispensing hole in a very short time. This dispenser has a very positive dispensing action and it positively vacuums out the dispensing hole during the return stroke. All parts can be molded from plastic or other moldable material and used without machining. The number of parts used to make this dispenser is far less than what is presently used in such dispensers. This dispenser is particularly suitable for domestic use. It has no flexible membrane or any spring loaded valves.

4 Claims, 3 Drawing Figures

SELF CLEANING SHAMPOO DISPENSER

This invention relates to a manually operated machine for dispensing liquid of any viscosity as long as the liquid will flow. This invention is designed in particular for domestic purposes like dispensing laundry detergent, hair washing shampoo or hair cream rinse etc.

There are a number of dispensers available on the market. Most of them are either too expensive to manufacture in mass production or are very inefficient.

Most dispensers are fitted with at least two spring loaded, one way ball type valves. After a very short use they plug up with dried or hardened soap. The dispenser either starts to drip and leak or becomes inoperative. This type of dispenser is not suitable for dispensing hair washing shampoo because shampoo tends to cling and dry up rapidly.

There are some dispensers designed to dispense soap suds. This type is also not suitable for dispensing shampoo.

There are yet other dispensers designed to dispense liquid. They consist of a cylinder, a piston, a storage area which has a fitting for an inverted bottle. The pressure chamber is situated below the storage area. The cylinder consists of separate inlet and outlet passages. It has a flexible membrane for the back wall or a solid wall together with a spring loaded member to form another wall in front of the solid wall. This is done to build up pressure in the pressure chamber when the piston is pushed in. The said membrane forces the liquid out of the dispensing hole when the piston is pushed in far enough that the outlet passage is in communication with the pumping chamber.

There are disadvantages with this kind of mechanism.

(1) Too much pressure could rupture the flexible membrane.

(2) It is possible that this membrane would become cracked after some use and leak.

(3) It is quite expensive to fix such a membrane on the dispensers.

(4) An extra spring loaded wall adds too many extra parts. The more the parts the greater the chance of a machine failure. If any liquid seeps behind this wall the dispenser becomes unoperative.

(5) In this type of a dispenser the dispensing is done by the said membrane, therefore the operator has no control over the rate of liquid flow from the outlet. Thin liquids would flow out very fast while the thick liquids would take a long time to flow out. One would have to have separate dispensers for thick or thin materials. It does not have a positive dispensing action.

(6) It needs a storage chamber which is perfectly sealed from the outer atmosphere. It needs vacuum in the storage chamber to prevent leaks at the dispensing hole.

(7) It needs very accurate size and finish in the pressure chamber and cylinder to prevent leaks at the aperture.

(8) All the above points make mass production very difficult and expensive.

My invention is designed to take the least number of parts, make easy assembly, easy manufacture of parts, give a better seal at the dispensing hole, give a positive dispensing action and positively vacuum out the dispensing hole during the return stroke.

In the drawings which illustrate embodiment of the invention:

Figure 1:
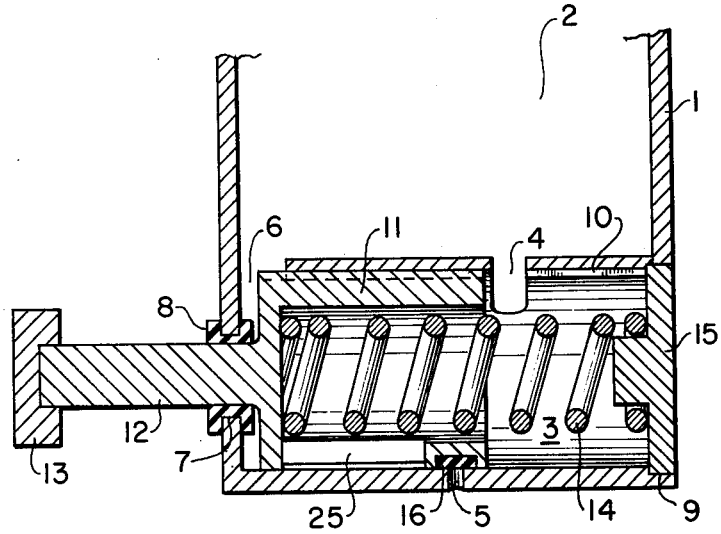
FIG. 1 is an axial sectional view of a shampoo dispenser according to my invention.

The illustrated embodiment of my invention in FIG. 1 shows dispenser body 1 consisting of a storage chamber 2, pumping chamber 3, an inlet passage 4 which permits liquid to flow from the storage chamber into the pumping chamber, an outlet aperture 5, an inlet passage 6 from the storage chamber to the back of the piston, hole 7 for a resilient grommet 8, an opening 9 at the rightward end of the pumping chamber. Keyway 10 in the cylinder which runs along its entire length and keeps the piston in line.

Piston 11 in FIG. 1 is shown in the rest position. The piston shaft 12 goes through the grommet such that there are no leaks at this end. Push button 13 is fitted on to the piston shaft. Return spring 14 returns the piston to its rest position after dispensing. Plug 15 is secured at the rightward end of the pumping chamber in the opening 9 to seal the pumping chamber after all parts have been inserted.

Figure 2A:
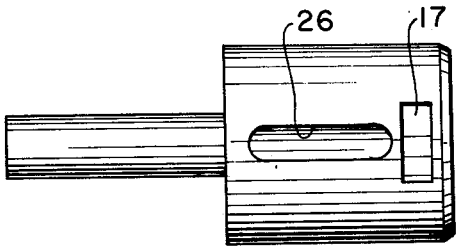
FIG. 2 is a bottom view of the piston.
Figure 2B:
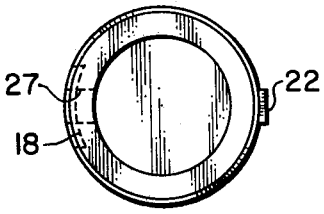
Figure 3A:
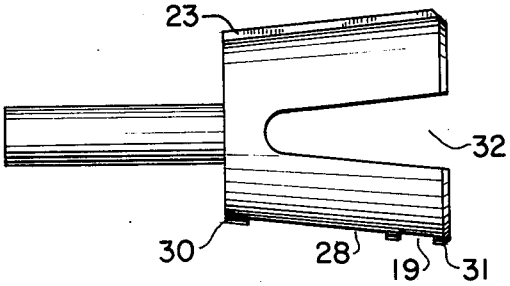
FIG. 3 shows an alternative construction for the piston. This piston is suitable for dispensers which have a tapered hole.
Figure 3B:
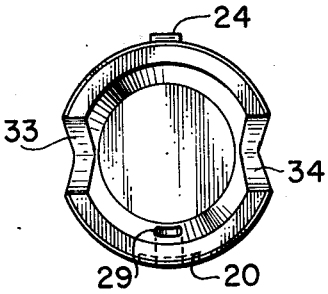

Seal 16 is made of sponge or other resilient material and fitted in the pocket 17, 18 (FIG. 2) or 19, 20 (FIG. 3) in the piston in such a way that it will exert pressure and block up the outlet aperture during the rest period. This seal travels with the piston as the piston slides in the pumping chamber. Key 22 in FIG. 2 or 23, 24 in FIG. 3 holds the piston in position such that the position of the seal is maintained.

The illustrated mechanism operates in the following way. When the piston is pushed in, it applies pressure on the liquid present in the pumping chamber. Some liquid is returned into the storage chamber through the inlet slot 4 and at the same time the liquid from the storage chamber starts to enter at the back of the piston through slot 6 to prevent vacuum in that area. When the piston is pushed in a certain distance the outlet slot 25 (FIG. 1), 26 and 27 (FIG. 2) and 28 and 29 (FIG. 3) in the piston is placed into communication with the outlet aperture. At this point the liquid starts to come out of the dispenser. Note that when the outlet aperture comes in communication with the pumping chamber this pumping chamber is on the point of being issolated from the storage chamber. As the piston continues to travel the liquid continues to be ejected through the outlet aperture.

During the return stroke vacuum is created in the pumping chamber. This vacuum sucks back the undispensed liquid from the outlet aperture into the pumping chamber further more the sudden vacuum very effectively cleans out the outlet aperture to prevent pluging up. The liquid which entered the back of the piston returns to the storage chamber through opening 6. During the rest period the spring applies pressure on the piston and the piston on the grommet. This further helps prevent any leaks.

The resilient seal 16 and the pocket for this seal in the piston is designed this way. The thickeness of the seal is slightly less than the depth of the pocket in the piston. The width of the seal is slightly less than the width of the pocket, but the length of the seal is slightly more than the length of the pocket in the piston so that the seal rests in the pocket of the piston in a bow shape. This way the seal can fit inside the pocket and stay there in a compressed form. The bow shape bulging outward from the piston keeps a constant gentle pressure on the pumping chamber wall and keep the outlet aperture blocked during the rest period, and at the same time the piston can slide freely inside the pumping chamber. The compression on the seal is along its length and not its thickeness.

During the rest period the entrapped air in the pumping chamber travels into the storage chamber and the liquid from the storage chamber takes the place of the departing air and fills up the pumping chamber for the next delivery.

My invention is designed in such a way that the cylinder hole can be molded in the main body from plastic or other such moldable materials and that no further machining is required. It is known that if a hole is formed in a molding, this hole has a slight taper on it to facilitate the extraction of the core plug. To get a good pressure build up using a straight piston one would have to ream this hole so that it was straight to suit the piston. To prevent reaming this hole and still get a good pressure build up I have designed the tapered piston shown in FIG. 3 (the amount of taper shown is exaggerated for purpose of illustration) The piston is designed in this way:

The small diameter 30 of the piston is slightly less than the small diameter of the cylinder at the left hand end and the large diameter 31 is almost the same as the largest diameter of the cylinder at the right hand end. Compression slot 32, 33 and 34 in FIG. 3 will allow the piston to shrink at the large diameter and part way along the piston length.

It should be noted when the piston is in the rest position, the large diameter of the piston is compressed and when the piston is being pushed in, the large diameter continues to expand as the diameter of the cylinder increases untill it reaches the end of the stroke. It can be clearly seen that this type of piston will increase efficiency without having to add rings or such extra parts on the piston.

I believe that in this invention I have made a dispenser which is very efficient and can be produced at a very low cost. All the parts (except for the return spring) can be molded and used with out any further machining. I have considerably reduced the number of parts which are now used to make a dispenser. This dispenser is totally leak proof and it has no parts which will plug up. It self-cleans the dispensing hole during return stroke to help prevent plugging of this hole with dried up soap. The pressure chamber is refilled during the rest period. There is no need for the flexible membrane or spring loaded second back wall. This second wall makes the dispenser inoperative if the liquid seeps in behind it.

Thus we have a dispenser comprising:

first means defining a liquid storage chamber, second means defining an elongated pumping chamber under said liquid storage chamber, an outlet aperture in said pumping chamber at a location intermediate its ends, a piston slidable within said chamber between a first position in which a portion of the piston blocks the aperture, and a second position in which said portion is displaced from blocking relation with said aperture such that the aperture is in communication with that part of the chamber to one side of the piston which shrinks in volume as the piston maves from said first toward said second position, whereby liquid in said part of the chamber is expelled through said aperture, third means by which said piston can be positively urged from said first toward said second position, resilient means for returning said piston from said second to said first position, such that during the return stroke a suction is created in the said part of the chamber which draws liquid remaining in the aperture into the chamber thus clearing the aperture, an opening from the storage chamber to the pumping chamber for allowing liquid to enter said part of the chamber from the liquid storage chamber, and for allowing any air in said part of the chamber to be displaced into the liquid storage chamber by the entering liquid, said opening being unblocked by the piston when the latter is in the first position, but being closed by the piston after a minor portion of its movement from the first toward the second position, the said aperture being unblocked by the piston at substantially the same time as, but not later than the closing of said opening occurs.

The embodiments of the invention in which an exclusive property or privilege is claimed are defined as follows:

1. A liquid dispenser comprising:

first means defining a liquid storage chamber, second means defining an elongated pumping chamber under said liquid storage chamber, said pumping chamber being of circular section and having a slight conical taper, an outlet aperture in said pumping chamber at a location intermediate its ends, a piston slidable within said pumping chamber between a first position in which a portion of the piston blocks the aperture, and a second position in which said portion is displaced from blocking relation with said aperture such that the aperture is in communication with that part of the chamber to one side of the piston which shrinks in volume as the piston moves from said first toward said second position, whereby liquid in said part of the chamber is expelled through said aperture, said first position being at a smaller-diameter location in the pumping chamber than said second position, said piston being tapered and having its small diameter toward the small-diameter end of the pumping chamber, the small diameter of the piston being slightly less than the smallest diameter of the pumping chamber, the large diameter of the piston being substantially the same as the largest diameter of the pumping chamber, the large-diameter end of the piston being compressible to allow the large-diameter end to shrink as the piston moves from the second toward the first position, and to expand as the piston moves in the reverse direction, third means by which said piston can be positively urged from said first toward said second position, resilient means for returning said piston from said second to said first position, such that during the return stroke a suction is created in the said part of the pumping chamber which draws liquid remaining in the aperture into the pumping chamber thus clearing the aperture, an opening from the storage chamber to the pumping chamber for allowing liquid to enter said part of the chamber from the liquid storage chamber, and for allowing any air in said part of the chamber to be displaced into the liquid storage chamber by the entering liquid, said opening being unblocked by the piston when the latter is in the first position, but being closed by the piston after a minor portion of its movement from the first toward the second position, the said aperture being unblocked by the piston at substantially the same time as, but not later than the closing of said opening occurs.

2. The invention claimed in claim 1, in which the piston is in the form of a hollow cylinder having one open end with an axially aligned slot beginning at a point displaced from the open end and extending so as to be aligned with said outlet aperture, the portion of the piston between the open end and the beginning of the slot causing the aperture to be blocked when the piston is in said first position, the slot allowing communication from said part of the chamber to the aperture as the piston moves from the first toward the second position, said piston having a plurality of compression slots extending axially from the large-diameter end.

3. The invention claimed in claim 1, in which said resilient means is a compression spring located in the said part of the chamber.

4. The invention claimed in claim 1, in which the said opening allows both liquid entry from the liquid storage chamber into the pumping chamber, and the exhaust of any entrapped air from the pumping chamber into the liquid storage chamber.

* * * * *